US006472806B1

(12) United States Patent
Kim et al.

(10) Patent No.: US 6,472,806 B1
(45) Date of Patent: Oct. 29, 2002

(54) TENSIONED SHADOW MASK FOR CATHODE RAY TUBE INCLUDING TIE BARS HAVING DUMMY BRIDGES

(75) Inventors: Wan Kim, Yongin (KR); Soon-chul Shin, Suwon (KR); Gwang-soo Kang, Suwon (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 0 days.

(21) Appl. No.: 09/461,758

(22) Filed: Dec. 16, 1999

(30) Foreign Application Priority Data

Jun. 30, 1999 (KR) ..... 99-25812

(51) Int. Cl.[7] ..... H01J 29/07; H01J 29/81
(52) U.S. Cl. ..... 313/403; 313/402; 313/269
(58) Field of Search ..... 313/402, 403, 313/407, 408, 409, 348, 269

(56) References Cited

U.S. PATENT DOCUMENTS 3,973,965 A * 8/1976 Suzuki et al. ..... 96/36.1
4,296,189 A 10/1981 Kuzminski
4,727,280 A 2/1988 Fujimura
4,926,089 A 5/1990 Moore ..... 313/403
4,942,332 A 7/1990 Adler et al.
5,583,391 A 12/1996 Good et al.
6,242,855 B1 * 6/2001 Caronna et al. ..... 313/402

FOREIGN PATENT DOCUMENTS

EP 487106 A1 5/1992
JP 57-065650 4/1982
JP 58225538 * 12/1983 ..... H01J/29/07

* cited by examiner

*Primary Examiner*—Nimeshkumar D. Patel
*Assistant Examiner*—Sikha Roy
(74) *Attorney, Agent, or Firm*—Leydig, Voit & Mayer, Ltd.

(57) ABSTRACT

A tensioned shadow mask for a cathode ray tube (CRT), including: a series of parallel strips separated by slits having a predetermined interval; a plurality of tie bars interconnecting adjacent strips to define a plurality of slits at predetermined intervals; and a plurality of dummy bridges disposed between adjacent tie bars, extending from one of the strips to the other but not interconnecting the adjacent strips, wherein a length of the dummy bridges is greater than a length of the tie bars in the longitudinal direction of the strips.

3 Claims, 9 Drawing Sheets

TENSIONED SHADOW MASK FOR CATHODE RAY TUBE INCLUDING TIE BARS HAVING DUMMY BRIDGES

BACKGROUND OF THE INVENTION

1. Field of the Invention

The present invention relates to a cathode ray tube (CRT), and more particularly, to a tensioned shadow mask with a color selection function.

2. Description of the Related Art

CRTs for television and computer displays employ a faceplate having on the inner side thereof a phosphor screen with a predetermined pattern, a mask and frame assembly which is an assembly of a shadow mask (hereinafter, simply referred to as a mask) and a frame, and is installed on the inner side of the faceplate, a funnel connected to the faceplate, which has a neck portion and a cone portion, and an electron gun inserted in the neck portion of the funnel, for emitting electron beams through apertures of the mask to excite the phosphor screen, and a deflection yoke installed around the cone portion of the funnel, for deflecting electron beams from the electron gun.

In a CRT having the above configuration, the mask for accurate landing of three electron beams emitted from the electron gun on each phosphor layer of the phosphor screen includes; a dot mask with substantially circular apertures a slot mask with parallel elongated apertures, and a tensioned mask to which tension is applied from opposite sides thereof, and having a series of parallel stripes separated by slits through which electron beams pass.

FIG. 1 shows an example of a tensioned mask. As shown in FIG. 1, the tensioned mask includes a plurality of strips 22 separated by slits 21 having a predetermined interval, and a plurality of tie bars 33 which interconnect the adjacent strips. The tensioned mask is supported in tension by a frame (not shown) of the tensioned mask.

In the mask, the tie bars 23 which interconnect the adjacent strips 22 can reduce a howling phenomenon, which occurs due to mask vibration from external impact, and unacceptable Poisson's contraction. However, if the vertical pitch of the tie bars 23 is too large, that is, if the vertical pitch (PV) of the tie bars 23 is twice or more the horizontal pitch (PH) thereof, a reflection image of the tie bars 23 is shown on the screen, which is unpleasant to viewers.

To avoid this problem, U.S. Pat. No. 4,926,089 discloses a tensioned mask as shown FIG. 2. As shown FIG. 2, the tensioned mask includes a plurality of strips 31 separated by slits 32 having a predetermined interval, and tie bars 33 which interconnect the adjacent strips 31. Also, dummy bridges 34, which extend partially between but not interconnecting adjacent strips, are disposed between the adjacent tie bars 34 and separate each slit 32 into sub-slits having a predetermined interval.

In the tensioned mask, due to a technical problem in mask pattern formation, the width W1 of the dummy bridges 34 is smaller than the width W2 of the tie bars 33. Thus, the reflection images by the dummy bridges 34 and the tie bars 33 have a slight difference in intensity of light. This difference raises the problem of tie bar visibility, thus deteriorating display image and making viewing unpleasant.

SUMMARY OF THE INVENTION

To solve the above problems, an object of the present is to provide a tensioned shadow mask for a cathode ray tube (CRT), capable of eliminating the problem of tie bar visibility while enhancing display image visibility.

In one embodiment of the present invention, there are provided a tensioned shadow mask for a CRT, comprising: a series of parallel strips separated by slits having a predetermined interval; a plurality of tie bars interconnecting adjacent strips to define a plurality of slits at predetermined intervals; and a plurality of dummy bridges disposed between adjacent tie bars, extending from one of the strips to the other but not interconnecting the adjacent strips, wherein the dummy bridges are longer than the tie bars in the longitudinal direction of the strips.

In the tensioned shadow mask according to the present invention, the area of the dummy bridges is equal to that of the tie bars, or the area difference between the dummy bridges and the tie bars is in a predetermined range. The dummy bridges may extend from a strip to the next strip but not intersecting the adjacent strips, or the dummy bridges may alternately extend from the adjacent strips such that a first dummy bridge extends from one of the adjacent strips and the next dummy bridge extends from the other of the adjacent strips.

BRIEF DESCRIPTION OF THE DRAWING

The above object and advantages of the present invention will become more apparent by describing in detail preferred embodiments thereof with reference to the attached drawings in which.

DESCRIPTION OF THE PREFERRED EMBODIMENTS

Figure 1:
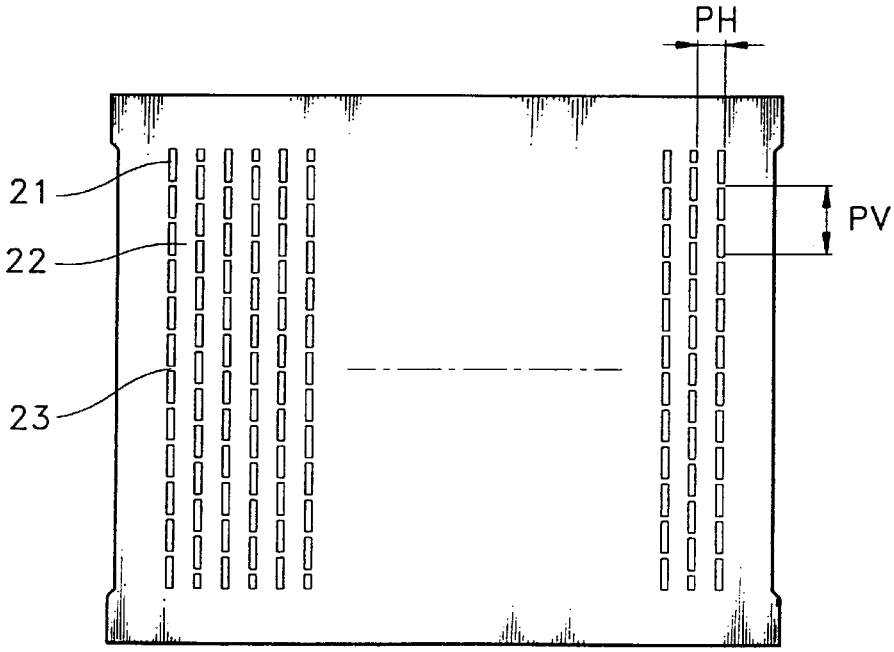
FIG.1 (PRIOR ART)
FIG. 1 is a plan view of a conventional tensioned mask for a color cathode ray tube (CRT)
Figure 2:
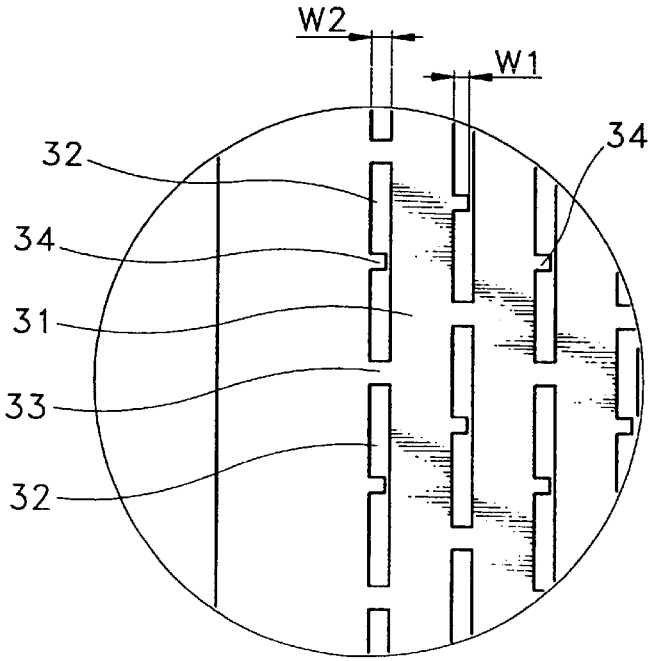
FIG.2 (PRIOR ART)
FIG. 2 is a partial enlarged view of the conventional tensioned mask, illustrating an aperture configuration thereof.
Figure 3:
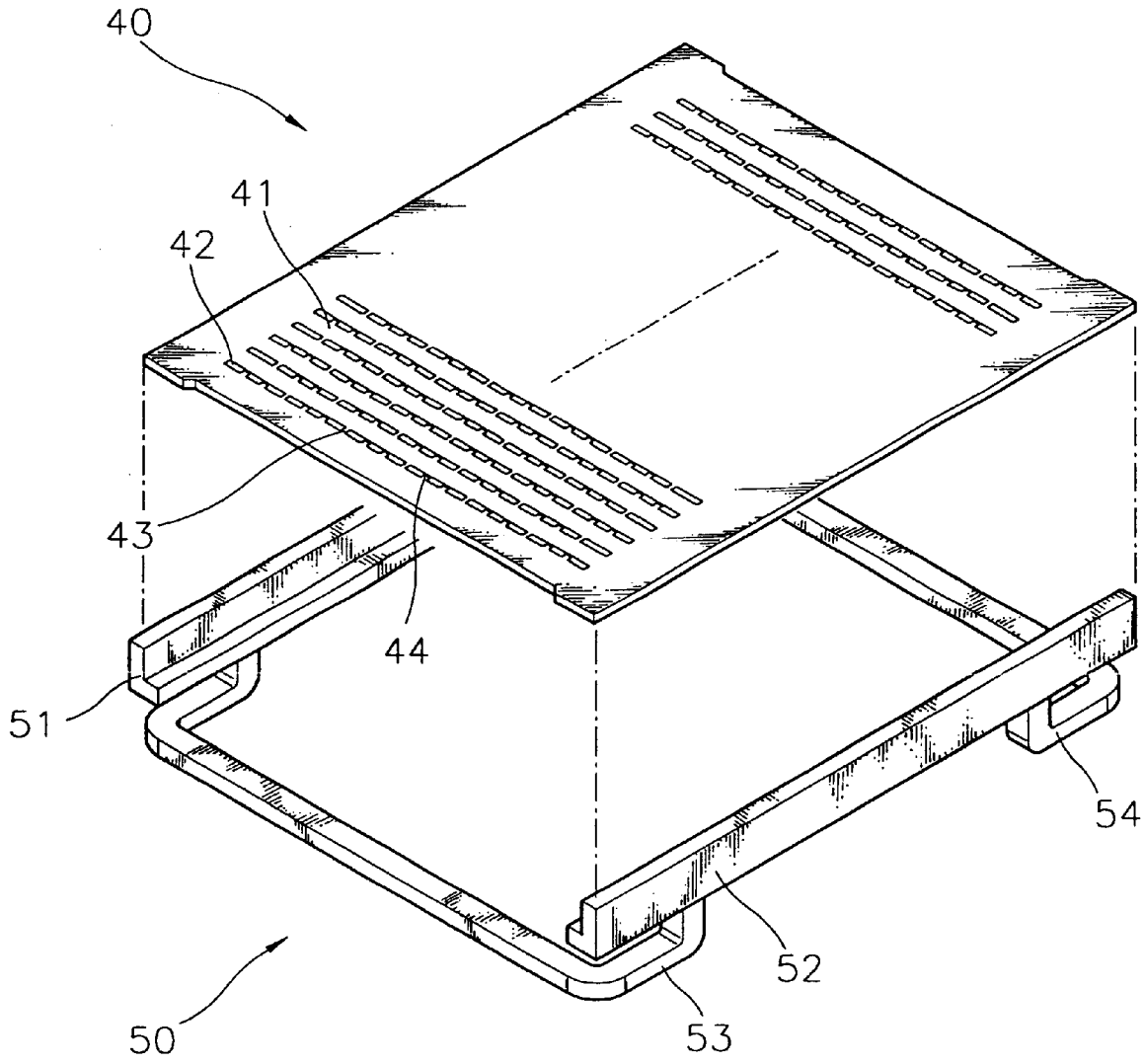
FIG. 3 is an exploded perspective view illustrating a state where a tensioned mask for a CRT according to the present invention is secured to a frame.
Figure 4:
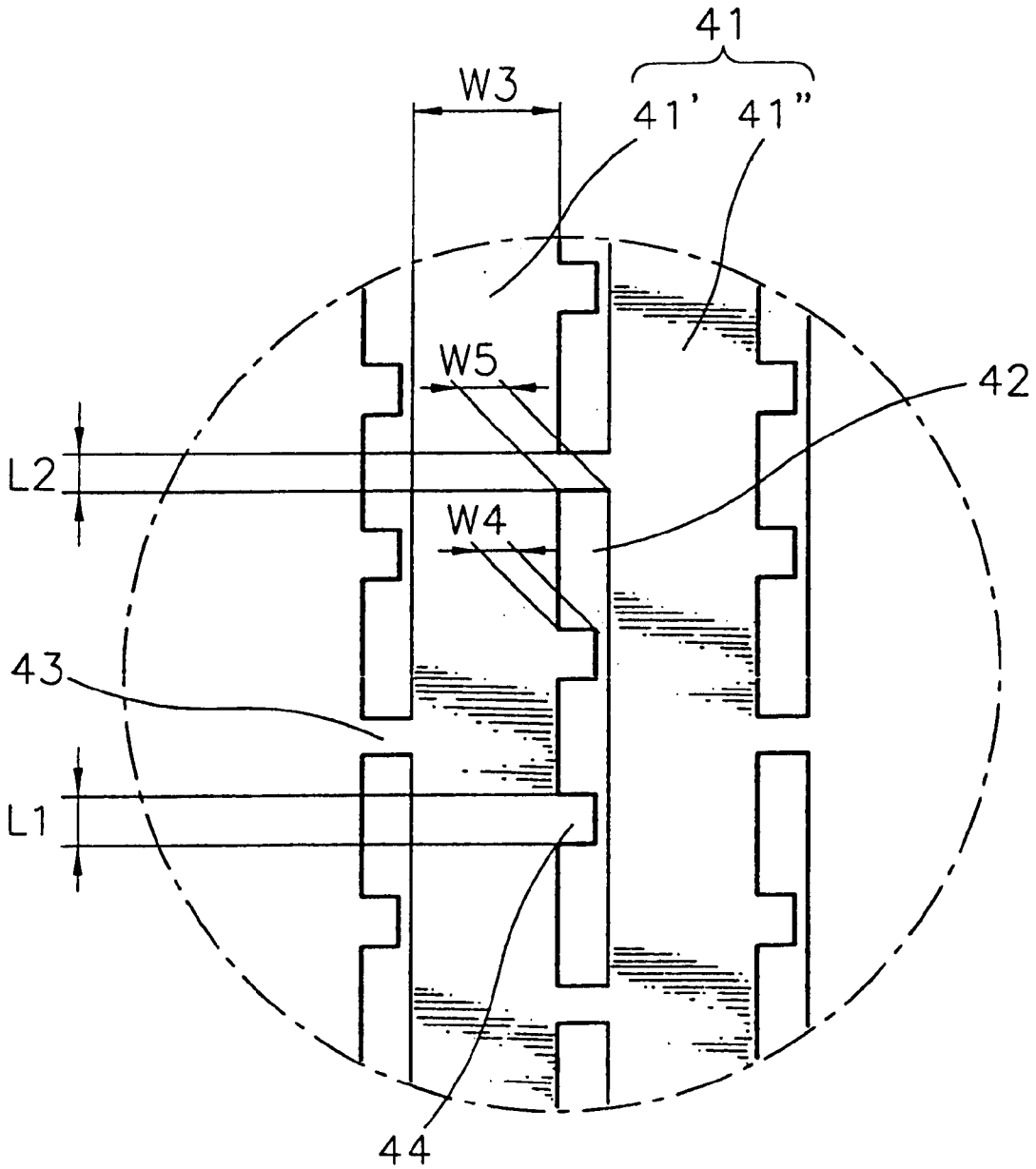
FIG. 4 is a partial enlarged view of the tensioned mask of FIG. 3, illustrating an aperture configuration thereof.

Referring to FIGS. 3 and 4, a tensioned mask and frame assembly includes a tensioned mask 40 and a frame 50 for supporting the tensioned mask 40 in tension. In the tension mask 40, which is formed of a 50–100 $\mu$m-thick foil, a series of strips 41 each having a width W1 of 190 $\mu$m are separated by slits 42 having a width of 60 $\mu$m. The slits 42 are separated by tie bars 43 which interconnect adjacent strips 41' and 41". The tie bars 43 are arranged in a staggered fashion in the transverse direction of the tensioned mask 40. Also, a plurality of dummy bridges 44, by which each slit 42 is separated into sub-slits having a predetermined interval, are disposed between the tie bars 43, wherein the dummy bridges 44 extend from one of the adjacent strips 41' and 41" to the other but not interconnecting the adjacent strips 41' and 41".

Figure 5:
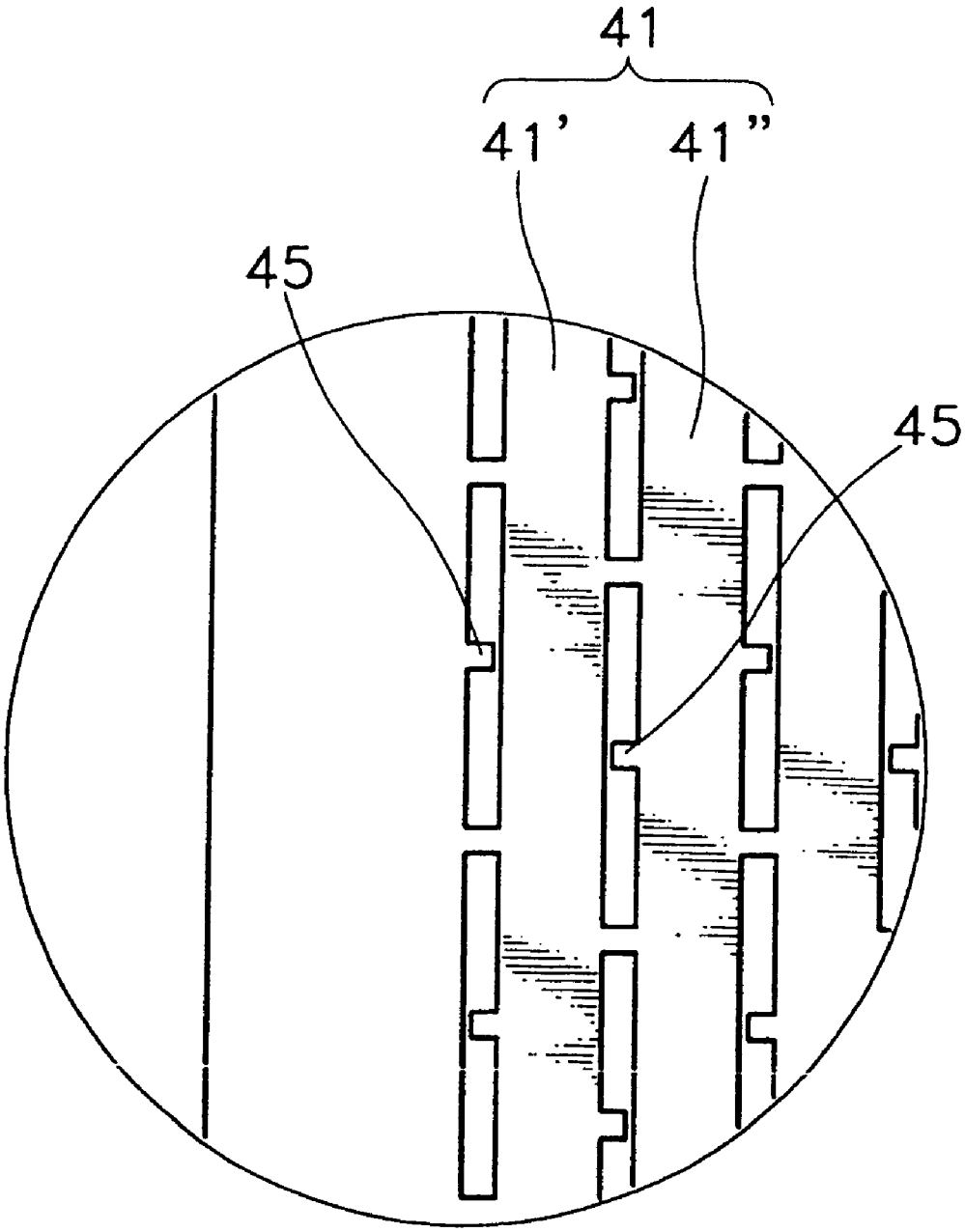
FIG. 5 is a partial enlarged plan views illustrating examples of the tensioned mask according to the present invention.

FIG. 5 shows another tensioned mask having the strips with dummy bridges arranged in a different manner from that of FIG. 3. As shown in FIG. 5, dummy bridges 45 alternately extend from one of the adjacent strips 41' and 41" such that a first dummy bridge extends from one of the adjacent strips 41' and 41" and the next dummy bridge extends from the other of the adjacent strips 41' and 41".

In the above embodiments, the length L1 of the dummy bridges 44 and 45 is larger than the length L2 of the tie bars 43, and the width W4 of the dummy bridges 44 or 45 is smaller than the width W5 of the tie bars 43. However, the area A1 (=L1×W4) of the dummy bridges 44 is equal to the area A2 (=L2×W5) of the tie bars 43, or the area difference between the dummy bridges 44 and the tie bars 43 is in a predetermined range. The area of the dummy bridges 44 or 45 may differ from that of the tie bars 43. However, it is preferable that the area of the dummy bridges 44 or 45 is equal to that of the tie bars 43, so that the tie bars will not visibly stand out. Also, the area of the dummy bridges 44 or 45 may be smaller or larger than that of the tie bars 43, as long as the area difference is in the range of 30 percent, which is expressed by $|(A1-A2)|/A2 \leqq 0.3$.

Also, as shown in FIG. 3, the frame 50 of the tensioned mask and frame assembly comprises a pair of supports 51 and 52 spaced a predetermined distance, for supporting the longer side edges of the tensioned mask 40, and a pair of elastic members 53 and 54 for applying tension to the tension mask 40, wherein both ends of the elastic members 53 and 54 are fixed to the supports 51 and 52. The frame configuration is not limited to the above configuration, and any configuration capable of acting tension on the tensioned mask can be adopted.

The tensioned mask is installed at the inner side of the faceplate, at a predetermined distance from the phosphor screen, being supported by the frame, provides a color selection function for accurate passage through the slits 42 and landing on the phosphor screen of the electron beams emitted from the electron gun.

The electron beams may be shielded by the tie bars 43 which define the slits 42 at predetermined intervals, or by the dummy bridges 44 or 45, which hinders complete excitation of the phosphor screen, thus resulting in a reflection image on the screen. However, the length L2 of the tie bars 43 is larger than the length L1 of the dummy bridges 44 or 45, and the area of the tie bars 43 is nearly equal to that of the dummy bridges 44 or 45, so that the reflection image area due to the tie bars 43, which corresponds to a nonexcited region of the phosphor screen, is nearly the same as that due to the dummy bridges 44 or 45. As a result, a real image and a reflection image are uniformly distributed over the screen, so that viewers scarcely perceive the reflection image, thereby improving appearance uniformity. The reflection image distribution can be controlled by varying the number of tie bars 43 and dummy bridges 44 or 45.

The tensioned mask of a CRT according to the present invention, having the above structure, is characterized in that the area of the dummy bridges is equal or similar to that of the tie bars, so that a decrease in resolution due to the reflection image of the tie bars can be avoided with an improved appearance uniformity.

The following embodiments are provided so that this disclosure will be thorough and complete.

EXPERIMENTAL EXAMPLE 1

The appearance uniformity with respect to the area difference between the tie bars and the dummy bridges was observed by varying the length of the dummy bridges relative to the length of the tie bars in a tensioned mask of a CRT for monitors. The result is shown in Table 1.

TABLE 1

| | Tie bar | | | Dummy bridge | | | | |
|---|---|---|---|---|---|---|---|---|
| Sample | Length (μm) | Width (μm) | Area (μm²) | Length (μm) | Width (μm) | Area (μm²) | Area ratio (%) | Appearance Uniformity |
| 1 | 60 | 60 | 3,600 | 60 | 30 | 1,800 | 50 | poor |
| 2 | 60 | 60 | 3,600 | 90 | 30 | 1,800 | 75 | moderate |
| 3 | 60 | 60 | 3,600 | 120 | 30 | 1,800 | 100 | good |
| 4 | 60 | 60 | 3,600 | 150 | 30 | 1,800 | 125 | moderate |

As can be noted from Table 1, the appearance uniformity is acceptable when the area of the tie bars is in a range greater than 70% and less than 130% of the area of the tie bars.

Figure 6:
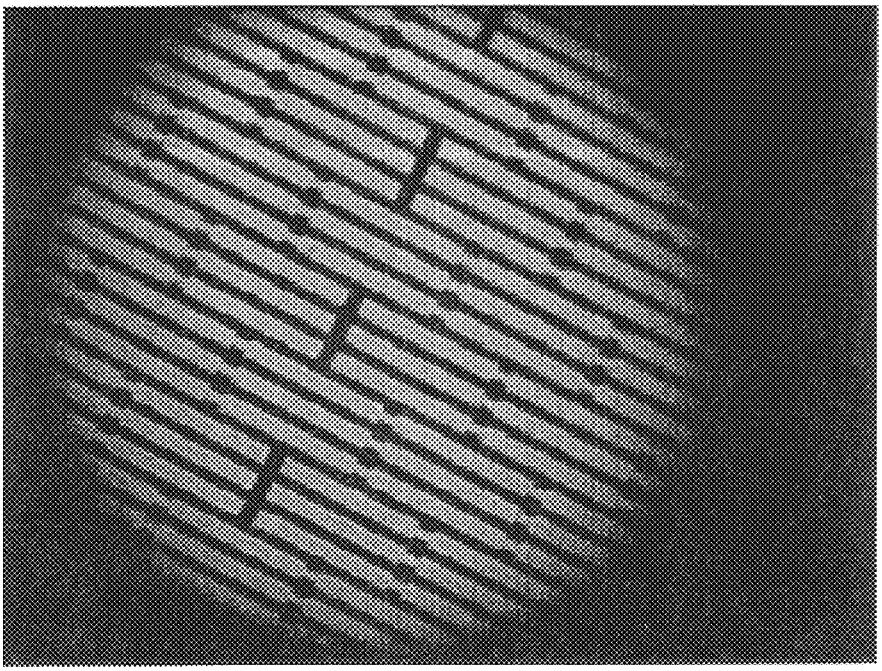
FIGS. 6 through 15 are photos illustrating the visibility of tie bars reflected on a phosphor screen with respect to the area difference between the tie bars and dummy bridges of tensioned masks.
Figure 7:
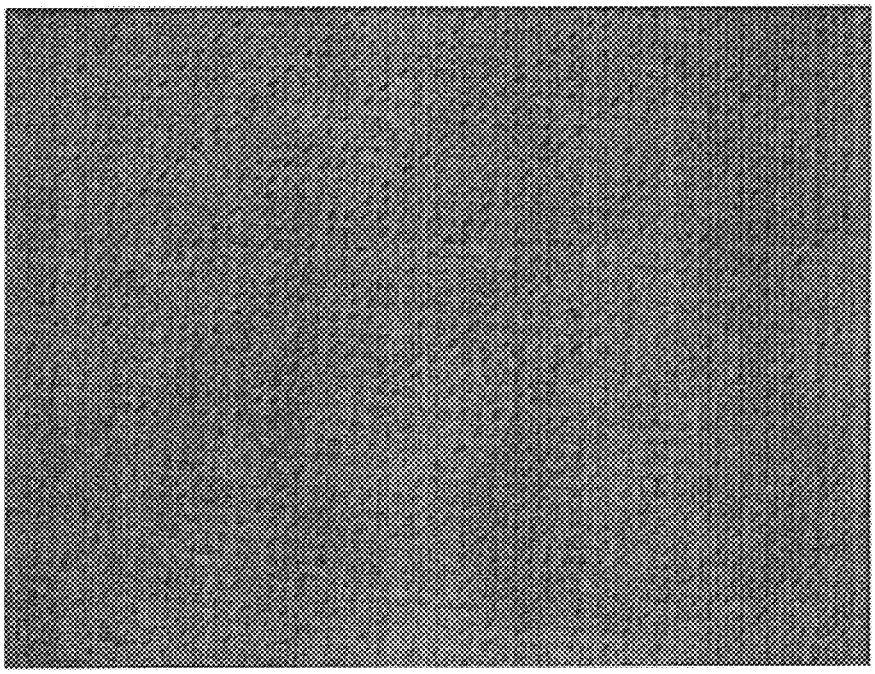

FIGS. 6 through 11 are photos illustrating the visibility of tie bars reflected on the phosphor screen, with respect to the area difference between the tie bars and dummy bridges of tensioned masks shown in Table 1. In particular, FIG. 7 is a macro photo in a case when the area of the dummy bridges is 50% of that of the tie bars (Sample 1 of Table 1), and FIG. 6 is a 20×-magnified photo of FIG. 7. As shown in FIGS. 6 and 7, distinct tie bar shadows appear on the phosphor screen.

Figure 8:
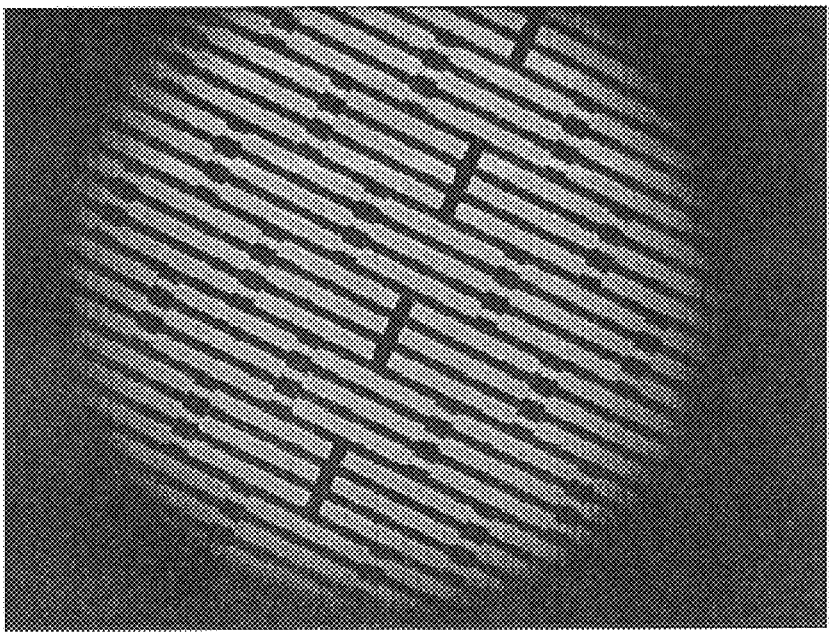
Figure 9:
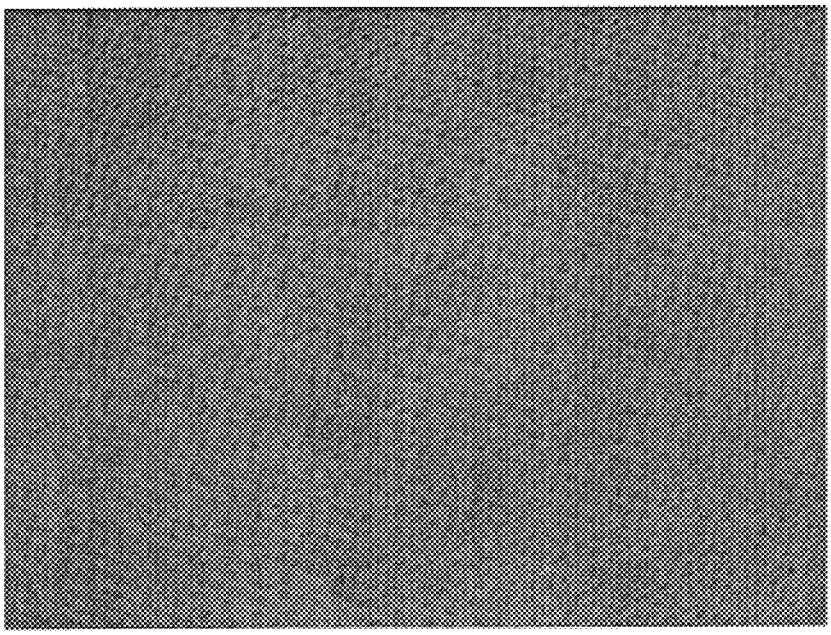

FIG. 9 is a macro photo showing the tie bar visibility on the phosphor screen when the area of the dummy bridges is 75% of that of the tie bar (Sample 2 of Table 1), and FIG. 8 is a 20×-magnified photo of FIG. 9. As shown in FIG. 8, the sizes of the reflection image by the tie bars and the dummy bridges appear to be equal to each other, showing a slight difference in intensity of light therebetween. Also, as shown in FIG. 9, it is difficult to distinguish the tie bar shadows on the phosphor screen from the dummy bridges shadows thereon.

Figure 10:
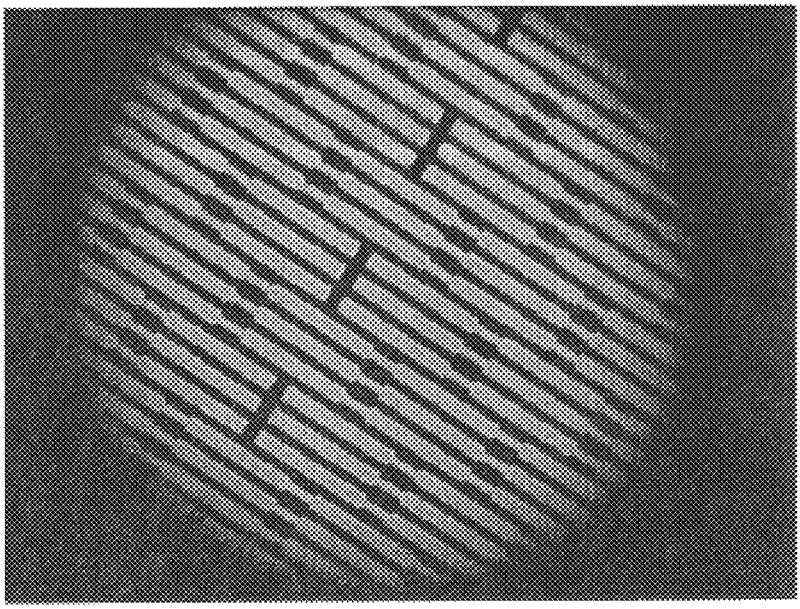
Figure 11:
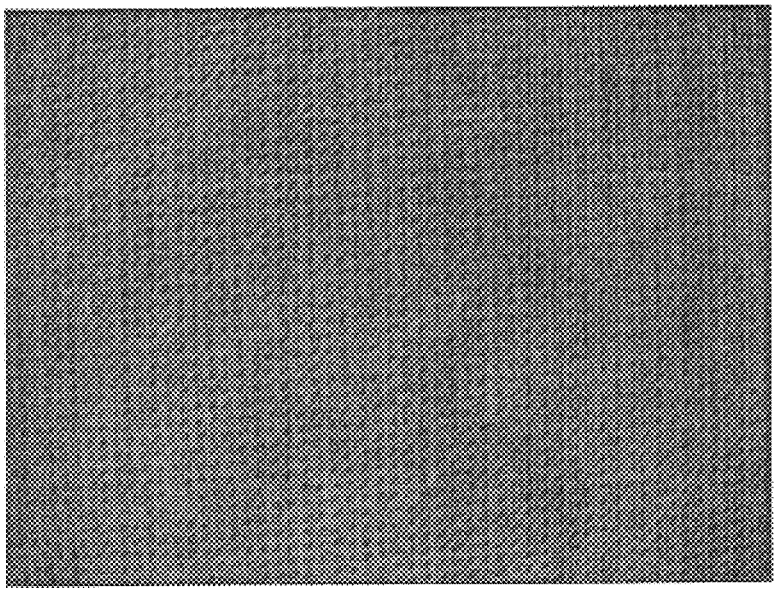

FIG. 11 is a macro photo showing the tie bar visibility on the phosphor screen when there is no difference in area between the tie bars and the dummy bridges (Sample 3 of Table 1), and FIG. 10 is a 20×-magnified photo of FIG. 11. In FIG. 10, the dummy bridges that are enlarged in the longitudinal direction so as to make the area of the dummy bridges equal to that of the tie bars are visible. As shown in FIG. 11, it is difficult to distinguish the tie bar shadows from the dummy bridges shadows, and the reflection images of the tie bars and dummy bridges show uniform intensity of light.

Although photos of the Sample 4 in Table 1, in which the area of the dummy bridges is 125% of that of the tie bars, were not taken, the size of the reflection image of the dummy bridges on the phosphor screen was large whereas that of the tie bars was small, compared to the Sample 3. Furthermore, the reflection image of the tie bars were shown as white dots on the screen.

EXPERIMENTAL EXAMPLE 2

The appearance uniformity with respect to the area difference between the tie bars and the dummy bridges was observed by varying the length of the dummy bridges relative to the length of the tie bars in a tensioned mask of a CRT for a television. The result is shown in Table 2.

TABLE 2

| | Tie bar | | | Dummy bridge | | | | |
|---|---|---|---|---|---|---|---|---|
| Sample | Length (μm) | Width (μm) | Area (μm²) | Length (μm) | Width (μm) | Area (μm²) | Area ratio (%) | Appearance Uniformity |
| 1 | 80 | 195 | 15,600 | 80 | 145 | 8,700 | 55 | poor |
| 2 | 80 | 195 | 15,600 | 80 | 145 | 11,600 | 74 | moderate |
| 3 | 80 | 195 | 15,600 | 108 | 145 | 15,660 | 100.3 | good |
| 4 | 80 | 195 | 15,600 | 140 | 145 | 20,300 | 130.1 | moderate |

As can be understood from Table 2, the appearance uniformity is acceptable when the area difference between the tie bars and dummy bridges is in the range of 30%.

Figure 12:
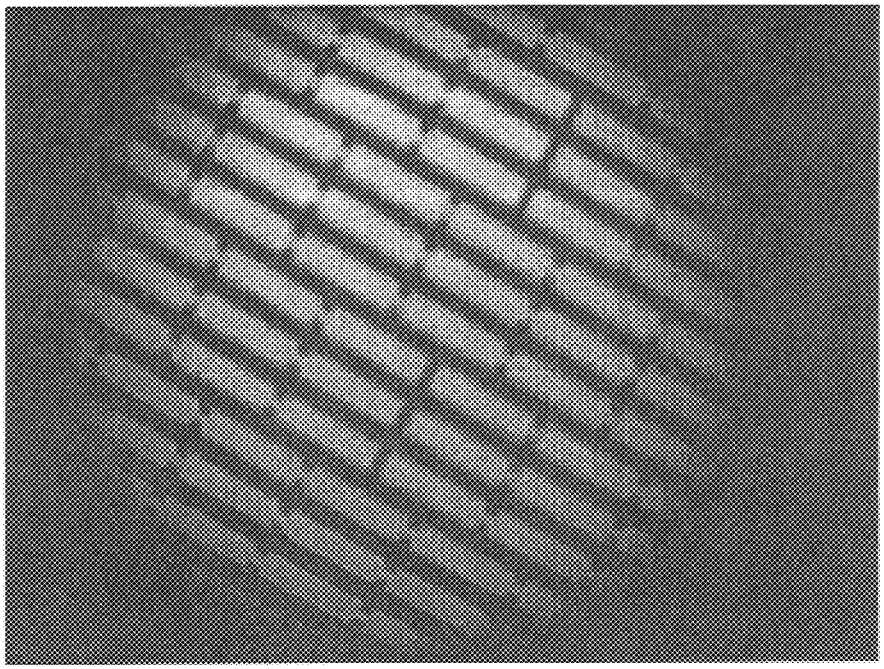
Figure 13:
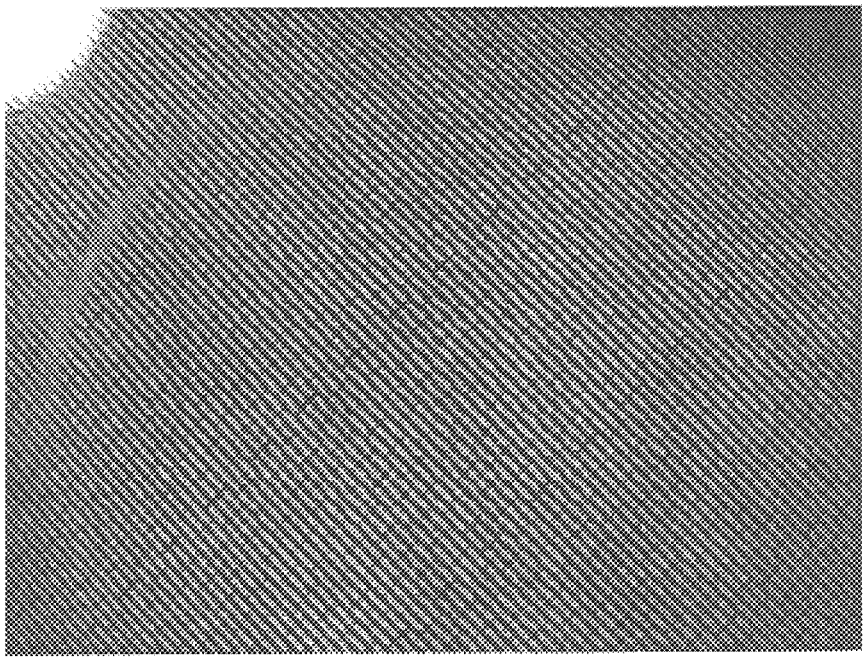

FIGS. 12 through 15 are photos illustrating the visibility of tie bars reflected on the phosphor screen, with respect to the area difference between the tie bars and dummy bridges of tensioned masks shown in Table 2. In particular, FIG. 13 is a macro photo in a case when the area of the dummy bridges is 55% of that of the tie bars (Sample 1 of Table 2), and FIG. 12 is a 10×-magnified photo of FIG. 13. As shown in FIGS. 12 and 13, although the resolution is poor, due to the large horizontal pitches of the phosphor pattern and the slits of the tensioned mask for a television, compared to those for monitors (Experimental Example 1), distinct tie bar shadows appear on the screen.

Figure 14:
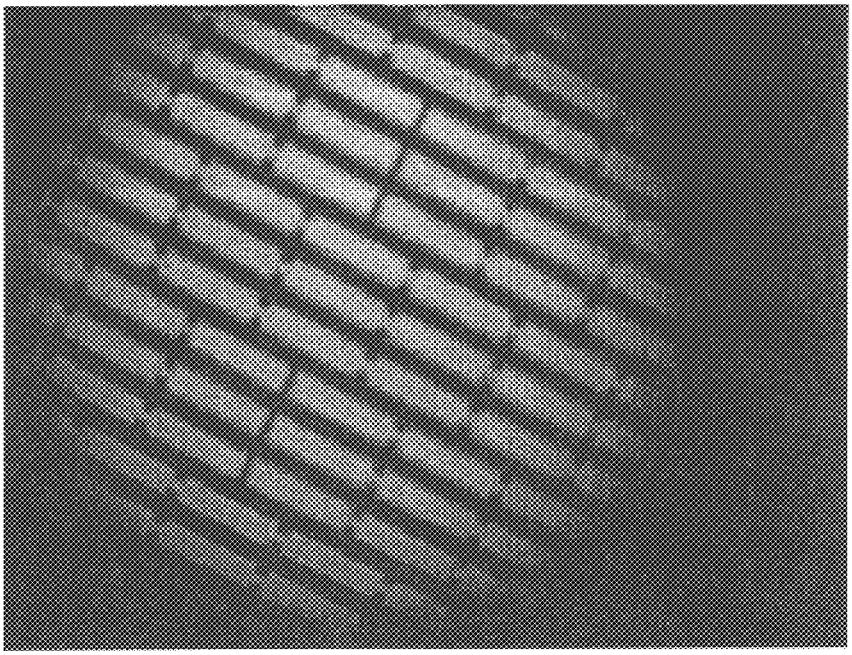
Figure 15:
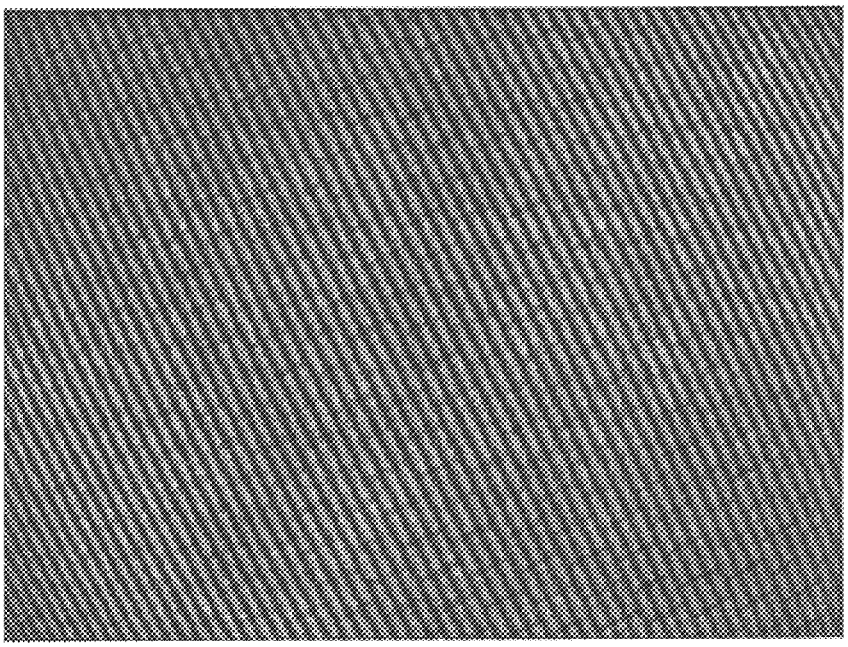

FIG. 15 is a macro photo showing the tie bar visibility on the phosphor screen when the area of the dummy bridges is 74% of that of the tie bars (Sample 2 of Table 2), and FIG. 14 is a 10×-magnified photo of FIG. 15. In FIG. 14, the dummy bridges that are enlarged in the longitudinal direction so as to make the area of the dummy bridges equal to that of the tie bars are distinct. As shown in FIG. 15, the reflection images of the tie bars and dummy tie bars have uniform intensity of light, so that it is difficult to distinguish the reflection image of the tie bars from that of the dummy tie bars, thus improving the appearance uniformity.

Although photos of the Sample 4 in Table 2, in which the area of the dummy bridges is 130% or more larger than that of the tie bars, were not taken, the size of the reflection image of the dummy bridges on the phosphor screen was large whereas that of the tie bars was small, compared to the samples described with reference to photos. Furthermore, the reflection image of the tie bars was shown as which dots the screen.

While the present invention has been illustrated and described with reference to specific embodiments, further modifications and alterations within the spirit and scope of this invention as defined by the appended claims will become evident to those skilled in the art.

What is claimed is:

1. A tensioned shadow mask for a cathode ray tube (CRT), comprising:

a series of parallel strips extending alone a longitudinal direction of the shadow mask and separated by respective longitudinal slits spaced from each other at an interval;

a plurality of tie bars, each tie bar interconnecting, along the longitudinal direction, two of the slits and, along a transverse direction, interconnecting adjacent strips; and a plurality of dummy bridges, disposed between adjacent tie bars, extending from respective strips transversely into the slits toward, but not interconnecting, an adjacent strip, wherein the dummy bridges are longer than the tie bars along the longitudinal direction of the shadow mask.

2. The tensioned shadow mask of claim 1, wherein each of the dummy bridges and the tie bars have respective areas, and the area of each dummy bridge is in a range greater than 70% and less than 130% of the area of each tie bar.

3. The tensioned shadow mask of claim 1, wherein the dummy bridges alternately extend from the adjacent strips such that a first dummy bridge extends from one of the strips into a slit in a first transverse direction and the dummy bridge of the adjacent slit in the longitudinal direction extends from an adjacent strip into the slit in a second transverse direction opposite the first transverse direction.

* * * * *